US006467137B1

(12) United States Patent
Kanda et al.

(10) Patent No.: US 6,467,137 B1
(45) Date of Patent: Oct. 22, 2002

(54) METHOD OF MANUFACTURING AN INK JET RECORDING HEAD

(75) Inventors: Torahiko Kanda; Yasuhiro Otsuka; Kazuhiro Ikuina; Takaharu Kondo; Katsuhiro Notsu, all of Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/395,541

(22) Filed: Sep. 14, 1999

(30) Foreign Application Priority Data

Sep. 17, 1998 (JP) ..... 10-263415

(51) Int. Cl.[7] ..... H04R 17/00; B21D 53/76

(52) U.S. Cl. ..... 29/25.35; 29/890.1; 29/830; 347/71; 347/72; 264/642; 156/89.11; 156/252

(58) Field of Search ..... 29/890.1, 25.35, 29/611, 830, DIG. 1; 347/68, 70, 71, 72, 45; 264/642, 678; 156/89.11, 89.12, 252; 310/324, 326

(56) References Cited

U.S. PATENT DOCUMENTS

| | | | | | |
|---|---|---|---|---|---|
| 4,080,414 A | * | 3/1978 | Anderson et al. | ..... | 264/642 |
| 4,680,595 A | * | 7/1987 | Cruz-Uribe et al. | ..... | 347/70 |
| 5,956,059 A | * | 9/1999 | Usui | ..... | 347/71 |

FOREIGN PATENT DOCUMENTS

| | | | | | |
|---|---|---|---|---|---|
| EP | 0695638 | | 2/1996 | | |
| EP | 0985532 | | 3/2000 | | |
| JP | 59-89163 | * | 5/1984 | ..... | 347/71 |
| JP | 60-184852 | * | 9/1985 | ..... | 347/45 |
| JP | 7-60960 | | 3/1995 | | |
| JP | 7-148921 | | 6/1995 | | |
| JP | 8-58089 | | 3/1996 | | |
| JP | 8-169111 | | 7/1996 | | |
| JP | 10-44443 | | 2/1998 | | |
| JP | 10-181013 | | 7/1998 | | |

OTHER PUBLICATIONS

German Office Action issued Oct. 11, 2000 in a related application English translation.

Japanese Office Action issued Dec. 12, 2000 in a related application with English translation of relevant portions.

* cited by examiner

*Primary Examiner*—Peter Vo
*Assistant Examiner*—A. Dexter Tugbang
(74) *Attorney, Agent, or Firm*—Dickstein, Shapiro, Morin & Oshinsky, LLP

(57) ABSTRACT

A method of manufacturing an ink jet recording head. On one and the other surfaces of an ink supply plate, formed with a plurality of discrete ink supply ports and a corresponding number of discrete nozzle ports, a green sheet for a pressure chamber plate and a green sheet for an ink pool plate are laminated, respectively. The resulting lamination is then sintered. A vibration plate is subsequently adhered to the pressure chamber plate formed by the sintering step and a nozzle plate is adhered to the sintered pool plate.

7 Claims, 13 Drawing Sheets

METHOD OF MANUFACTURING AN INK JET RECORDING HEAD

CROSS REFERENCE TO RELATED APPLICATIONS

The present invention claims priority from Japanese Patent Application No. 10-263415 filed Sep. 17, 1998, the contents of which are incorporated herein by reference.

BACKGROUND OF THE INVENTION

1. Field of the Invention

The present invention is utilized in a printer for a computer, a facsimile or a copier, etc. The present invention relates to an improvement of a structure of an ink jet recording head to be used in an ink jet recorder and a manufacturing method thereof. Particularly, the present invention relates to an improvement of an ink jet recording head having pressure chambers each having a wall surface made of ceramics, for selectively pressurizing ink therein to jet ink droplets through nozzles of the head.

2. Description of Related Art

An ink jet recording head comprises a plurality (n) of nozzles, n discrete pressure chambers provided correspondingly to the respective n nozzles, an actuator for selectively producing mechanical displacement in the discrete pressure chambers and an ink pool for supplying ink to the discrete pressure chambers. The number n of the nozzles may be, for example, 24 or 48. The actuator is driven such that an internal pressure of each discrete pressure chamber corresponding to a nozzle from which ink is to be jetted is pulsated. The n nozzles are usually arranged with an interval of from several millimeters to ten and several millimeters and the ink jet recording head is compact. Therefore, the ink jet recording head must be realized by precise machining.

One example of a conventional ink jet recording head having such structure is disclosed in Japanese Patent Application Laid-open No. Hei 8-58089, in which wall surface portions of discrete pressure chambers are formed of ceramics. With the use of ceramics as the wall surface material of the discrete pressure chambers, an anti-corrosive, ink jet recording head can be realized. Therefore, the life of the ink jet recording head can be elongated. Further, since ceramics material has high rigidity, it is possible to reduce mechanical displacement of a wall surface of each discrete pressure chamber by internal pressure of the discrete pressure chamber, compared with a case where a similar wall structure is realized by adhering plastic material and metal material together. This structure is superior in that an amount of ink to be jetted from a nozzle can be made uniform and that unnecessary pressure propagation (cross-talk) to adjacent discrete pressure chambers is small.

The present inventors had investigated the above mentioned conventional structure disclosed in Japanese Patent Application Laid-open No. Hei 8-58089 and have found that it is impossible to check an interior of each discrete pressure chamber of the disclosed structure during a manufacturing process since sintering of ceramics is performed in a state where the discrete pressure chambers are substantially sealed. That is, when the ceramics sintering process is performed while the discrete pressure chambers are substantially sealed, there may be a case where extraneous substances resulting from such as partial falling of ceramics material are left as they are in the discrete pressure chambers.

Further, there may be a case where a volume of each discrete pressure chamber is occasionally becomes larger or smaller than a standard volume. Since such defect, if any, is found by an operation test of a finished ink jet recording head, the manufacturing yield is degraded, causing the cost of product to be increased.

In the structure in which the discrete pressure chambers are substantially sealed, it is impossible to easily perform a hydrophilic processing and other processing for inner wall surfaces of the discrete pressure chambers. Therefore, it is difficult to obtain a required operation performance of the ink jet recording head and the life of the ink jet recording head is shortened.

SUMMARY OF THE INVENTION

The present invention was made in view of the above mentioned difficulty and has an object to provide a structure of an ink jet recording head in which surface portions of walls of an ink pool and discrete pressure chambers can be formed of ceramics to provide superior anti-corrosive characteristics against ink and reduced mechanical displacement of the discrete pressure chambers and interiors of the discrete pressure chambers and the ink pool can be checked during a manufacturing steps and the manufacturing method thereof.

Another object of the invention is to reduce a product cost by improving yield thereof.

Another object of the present invention is to provide a structure of an ink jet recording head having discrete pressure chambers can be performed for interiors of the discrete pressure chambers thereof and a manufacturing method thereof.

A further object of the present invention is to provide a structure of an ink jet recording head in which cross-talk between adjacent discrete pressure chambers is reduced and in which density of discrete pressure chambers can be increased, size can be reduced and nozzles can be increased in number, and a manufacturing method thereof.

In order to achieve the above objects, the manufacturing method of the present invention is featured by that the durability and reliability of an ink jet recording head formed of ceramics are improved and the printing quality is improved. In the present invention, the sintering step is performed while the discrete pressure chambers and the ink pool are open and the discrete pressure chambers are sealed by adhering a vibration plate to the pressure chamber plate after a check step.

That is, a first feature of the present invention is a first method for manufacturing an ink jet recording head having discrete pressure chambers each having a ceramics wall surface, comprising the steps of laminating, on one and the other surfaces of an ink supply plate formed with a plurality of discrete ink supply ports and the corresponding number of nozzle ports, a green sheet for a pressure chamber plate and a green sheet for an ink pool plate, respectively, sintering a lamination resulting from the laminating step and adhering a vibration plate to said pressure chamber plate sintered in the sintering step and a nozzle plate to said sintered pool plate.

The ink supply plate may be made of metal. Alternatively, the ink supply plate may be of ceramics. In the latter case, it may be a green sheet in this stage or a ceramics plate provided by preliminarily sintering the green sheet. The first method may further comprises, between the sintering step and the adhering step, the step of checking wall surfaces of the discrete pressure chambers or the step of performing a hydrophilic processing with respect to the ceramics wall surfaces of the discrete pressure chambers. That is, the discrete pressure chambers after the sintering step are in open state, so that interiors of the discrete pressure chambers can be checked by a microscope, etc., to exclude the ink supply plate having defect, if any. Further, it is possible to perform the ceramics wall surface processing.

It is preferable that the green sheet for the pressure chamber plate is formed with holes corresponding to the discrete pressure chambers before the laminating step and the green sheet for the ink pool plate is formed with a hole corresponding to the ink pool before the laminating step.

In the first manufacturing method, the ink supply plate is prepared first and then a plurality of discrete ink supply ports and the same number of discrete nozzle ports communicated with respective nozzles are formed in the ink supply plate. Thereafter, a green sheet for the discrete pressure chamber plate and a green sheet for the ink pool plate are prepared, holes corresponding to the discrete pressure chambers are formed in the green sheet for the pressure chamber plate and a hole corresponding to the ink pool and holes corresponding to the discrete nozzle ports are formed in the green sheet for the ink pool plate.

The green sheets for the pressure chamber plate having the holes corresponding to the discrete pressure chambers and the ink pool plate having the holes corresponding to the ink pool and the discrete nozzle ports are attached to respective surfaces of the ink supply plate and sintered.

Since, in a lamination resulting from the sintering step, one side of each discrete pressure chamber formed in the green sheet for the pressure chamber plate is open and one side of the ink pool and the discrete nozzle ports formed in the green sheet for the ink pool plate is open, wall surfaces of the discrete pressure chambers, the ink pool and the discrete nozzle ports can be checked in this stage and the hydrophilic processing can be performed for the wall surfaces in this stage. Thereafter, the vibration plate is adhered to the sintered nozzle plate and the nozzle plate is adhered to the ink pool plate.

A second feature of the present invention is a second method for manufacturing an ink jet recording head having discrete pressure chambers each having a ceramics wall surface, comprising the steps of, after the laminating step in the first method and before the sintering step in the first method, forming holes corresponding to the discrete pressure chambers in the green sheet for the pressure chamber plate and forming a hole corresponding to the ink pool in the green sheet for the ink pool plate.

In the second manufacturing method, a green sheet for the pressure chamber plate and a green sheet for the ink pool plate are laminated on one and the other surfaces of the ink supply plate (made of metal or ceramics) formed with the ink supply port and the discrete nozzle ports, respectively, and patterned masks are formed on opposite surfaces of the lamination, respectively. The ink supply plate may be of metal or ceramics. In the case of the ceramics ink supply plate, it may be a green sheet in this stage or a ceramics plate provided by preliminarily sintering the green sheet.

Then, the lamination is sand-blasted through the patterned masks to form the discrete pressure chambers, the ink pool and the discrete nozzle ports and the patterned masks are removed. Thereafter, the lamination is sintered. The pressure chamber plate and the ink pool plate thus formed by the sintering are checked and then subjected to hydrophilic processing. Thereafter, a vibration plate is adhered to the pressure chamber plate and a nozzle plate is adhered to the ink pool plate.

A third feature of the present invention is a third manufacturing method for manufacturing an ink jet recording head having discrete pressure chambers each having a ceramics wall surface, comprising the steps of pattern-printing, on one and the other surfaces of an ink supply plate (3) (made of metal or ceramics) preliminarily formed with a plurality of discrete ink supply ports and the corresponding number of discrete nozzle ports, glass-contained ceramics paste layers, respectively, sintering the ink supply plate and adhering a vibration plate to the sintered pressure chamber plate and a nozzle plate to the ink pool plate.

In the third manufacturing method, the ink supply plate is prepared first and then discrete ink supply ports and the corresponding number of discrete nozzle ports are formed in the ink supply plate. Then, the patterned masks are formed on the respective surfaces of the ink supply plate by laminating glass-contained ceramics paste layers, which become the pressure chamber plate and the ink pool plate, and patterning them. The ink supply plate may be of metal or ceramics. In the latter case, it may be a green sheet in this stage or a ceramics plate provided by preliminarily sintering the green sheet.

Thereafter, the ink supply plate is sintered to form discrete pressure chambers in the pressure chamber plate and the ink pool and the discrete nozzle ports in the glass-contained ceramics paste layer (containing ceramics powder and organic binder) which becomes the ink pool plate. Then, wall surfaces of the discrete pressure chambers, the ink pool and the discrete nozzle ports are checked and then the hydrophilic processing is performed therefor. Thereafter, the vibration plate is adhered to the pressure chamber plate and the nozzle plate is adhered to the ink pool plate.

A fourth feature of the present invention is a fourth manufacturing method for manufacturing an ink jet recording head having discrete pressure chambers each having a ceramics wall surface, comprising the steps of forming, on one and the other surfaces of an ink supply plate formed of metal or ceramics and preliminarily formed with a plurality of discrete ink supply ports and the corresponding number of discrete nozzle ports, photo resist layers, respectively, exposing the photo resist layers with using a mask having a light transparent portion corresponding to holes of a pressure chamber plate and a mask having a light transparent portion corresponding to a hole of a pool plate, respectively, and removing unexposed portions of the ceramics paste layers, filling portions from which the ceramic paste is removed with ceramics paste (containing ceramics powder and organic binder), sintering the ink supply plate prepared in the filling step and adhering a vibration plate to the pressure chamber plate sintered in the sintering step and a nozzle plate to the sintered ink pool plate.

In the fourth manufacturing method, a metal ink supply plate is prepared first and then discrete ink supply ports and discrete nozzle ports are formed in the ink supply plate. Thereafter, photo resist layers in the form of films are formed on respective surfaces of the ink supply plate. Then, the photo resist layers are exposed with using a mask having a light transparent portion corresponding to holes of the pressure chamber plate and a mask having a light transparent portion corresponding to holes of the ink pool and then unexposed portions of the photo resist layers are removed by suitable chemical agent.

Thereafter, the portions from which the unexposed portions of the photo resist layers are removed are filled with ceramics paste and the ink supply plate formed by this filling is sintered. The pressure chamber plate and the ink pool plate thus formed by the sintering are checked and then the hydrophilic processing is performed for them. Then, the vibration plate is adhered to the pressure chamber plate and the nozzle plate is adhered to the ink pool plate.

A fifth feature of the present invention is a fifth manufacturing method for manufacturing an ink jet recording head having discrete pressure chambers each having a ceramics wall surface, comprising the steps of forming, on one and the other surfaces of an ink supply plate formed of metal or ceramics and preliminarily formed with a plurality of discrete ink supply ports and the corresponding number of discrete nozzle ports, glass-contained ceramics paste layers containing photo setting resin, respectively, exposing the photo resist layers with using a mask having a light translucent portion corresponding to holes of a pressure chamber plate and a mask having a light translucent portion corresponding to a hole of a pool plate, respectively, and removing unexposed portions of the ceramics paste layers, sintering the ink supply plate prepared in the removing step and adhering a vibration plate to the pressure chamber plate sintered in the sintering step and a nozzle plate to the sintered ink pool plate.

In the fifth manufacturing method, glass-contained ceramics paste layers (containing ceramics powder and organic binder) containing photo setting resin are formed on both surfaces of an ink supply plate (made of metal or ceramics) preliminarily formed with discrete ink supply ports and discrete nozzle ports. Then, the glass-contained ceramics paste layers are exposed with using a mask having a light translucent portion corresponding to holes of the pressure chamber plate and a mask having a light translucent portion corresponding to holes of the ink pool plate, and unexposed portions of the ceramics paste layers are removed. Thereafter, the ink supply plate formed by removal of the unexposed portions of the ceramics paste layers is sintered. Then, the pressure chamber plate and the ink pool plate formed by the sintering are checked and subjected to hydrophilic processing. Then, the vibration plate is adhered to the pressure chamber plate and the nozzle plate is adhered to the ink pool plate.

A sixth feature of the present invention resides in a structure of an ink jet recording head having discrete pressure chambers each having a ceramics wall surface and manufactured by the above mentioned manufacturing method, in which a pressure chamber plate formed with spaces each having a configuration of a discrete pressure chamber and an ink pool plate formed with a space having a configuration of an ink pool are adhered to one and the other surfaces of an ink supply plate preliminarily formed with a plurality of discrete ink supply ports and a plurality of discrete nozzle ports, respectively, and sintered, and in which a vibration plate is adhered to the pressure chamber plate and a nozzle plate formed with discrete nozzles is adhered to the pool plate. The ink supply plate may be made of metal or ceramics.

Ink is continuously supplied to the ink pool formed in the ink pool plate and ink in the ink pool is supplied to the discrete pressure chambers of the pressure chamber plate through the respective discrete ink supply ports of the ink supply plate. When the vibration plate is driven by the actuator to pressurize the interiors of the discrete pressure chambers, ink in the discrete pressure chambers is jetted from the nozzles provided in the nozzle plate through the discrete nozzle ports formed in the ink supply plate and the ink pool plate. With the ink jet, a printing is performed.

As described hereinbefore, according to the manufacturing method of the present invention, it is possible to precisely form the wall surfaces of the discrete pressure chambers and the ink pool by using ceramics, so that it is possible to maintain the superior characteristics of durability against ink and. reduction of the mechanical displacement of the discrete pressure chambers. Further, it is possible to check the interiors of the discrete pressure chambers and the ink pool during the manufacturing thereof since the sintering is performed with the discrete pressure chambers and the ink pool being open. Therefore, it is possible to exclude ink jet recording heads having defects such as falling-off of the ceramics parts and deformation thereof during sintering before the ink jet recording heads are finished. It is also possible to perform the hydrophilic processing and other processing for the interior of the discrete pressure chambers and the ink pool. Therefore, it is possible to reduce. the cross-talk between the adjacent discrete pressure chambers to thereby improve the yield of products and reduce the product cost. Further, it is possible to increase the density of the discrete pressure chambers, to reduce the size of the head and to increase the number of nozzles.

BRIEF DESCRIPTION OF THE DRAWINGS

Specific embodiments of the present invention will now be described, by way of example only, with reference to the accompanying of drawings in which.

DETAILED DESCRIPTION OF THE PREFERRED EMBODIMENTS

First, an ink jet recording head manufactured according to the present method will be described with reference to FIGS.

Figure 1:
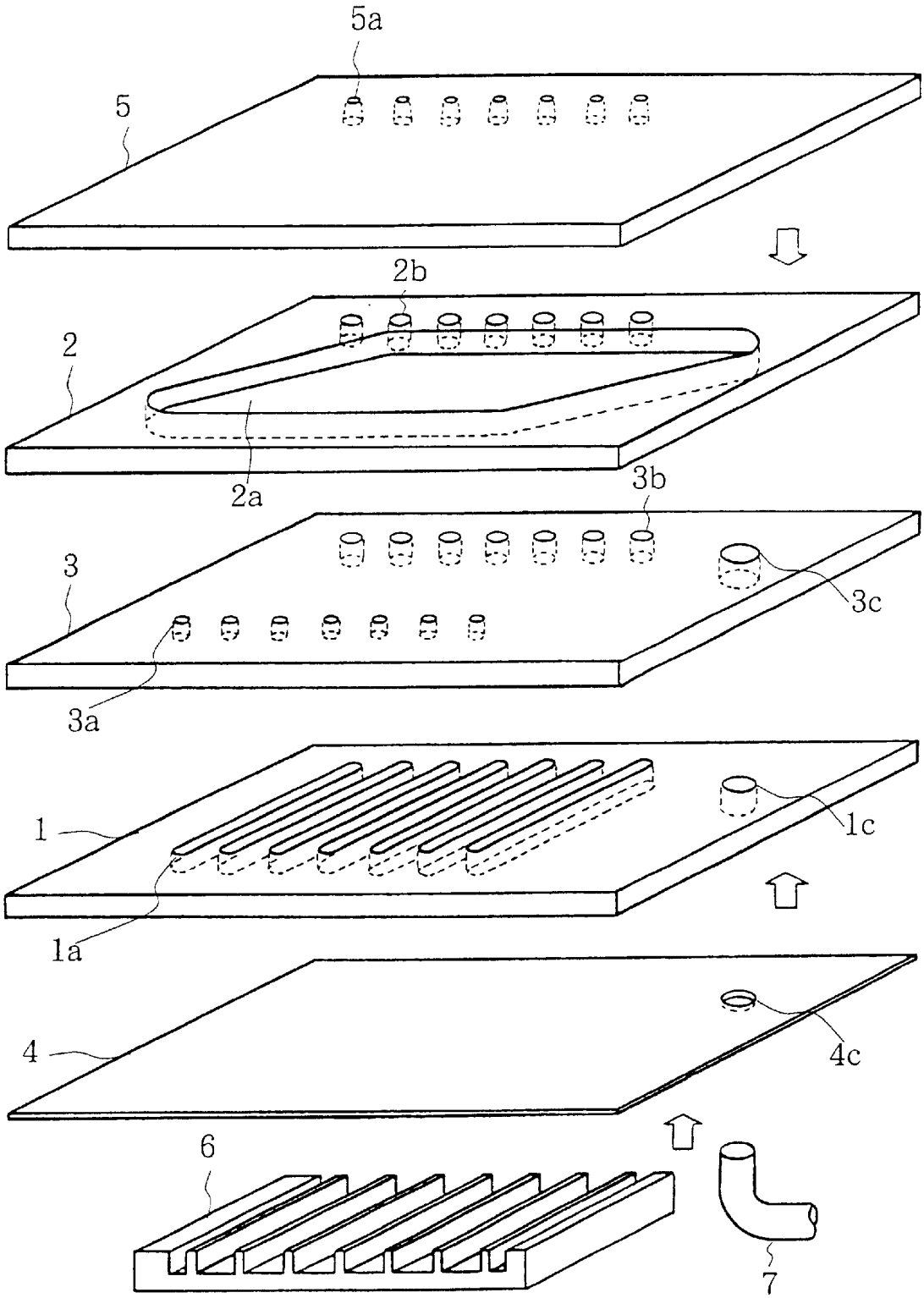
FIG. 1 is a perspective view of an ink jet recording head in disassembled state, which is manufactured according to a first embodiment of the manufacturing method of the present invention in disassembled state.
Figure 2:
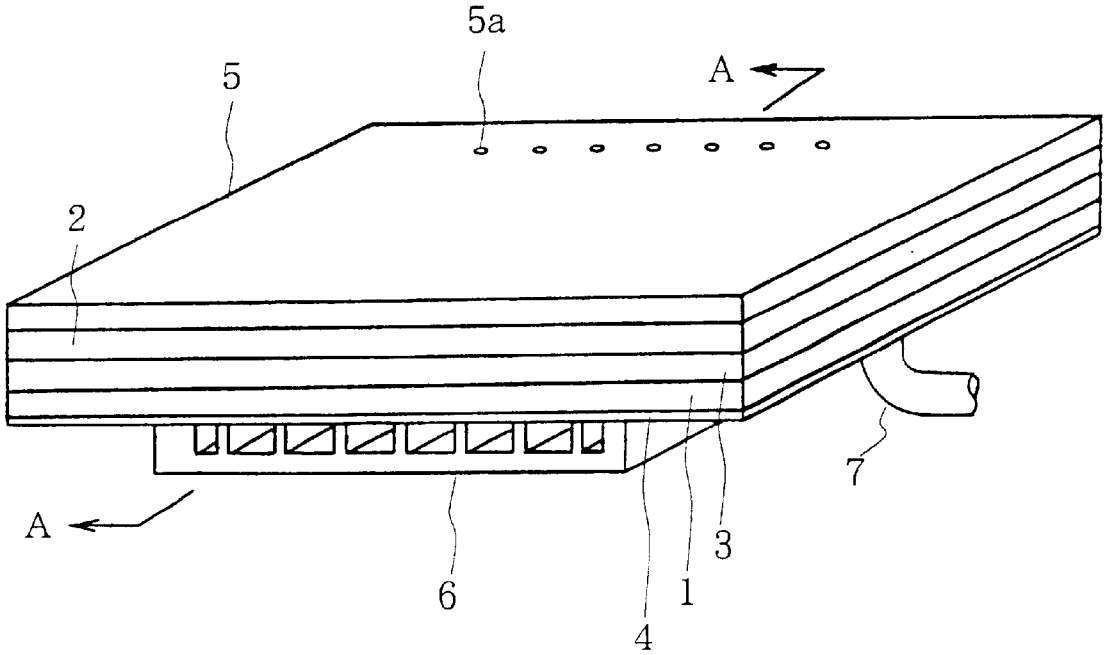
FIG. 2 is a perspective view of the ink jet recording head shown in FIG. 1, in assembled state.
Figure 3A:
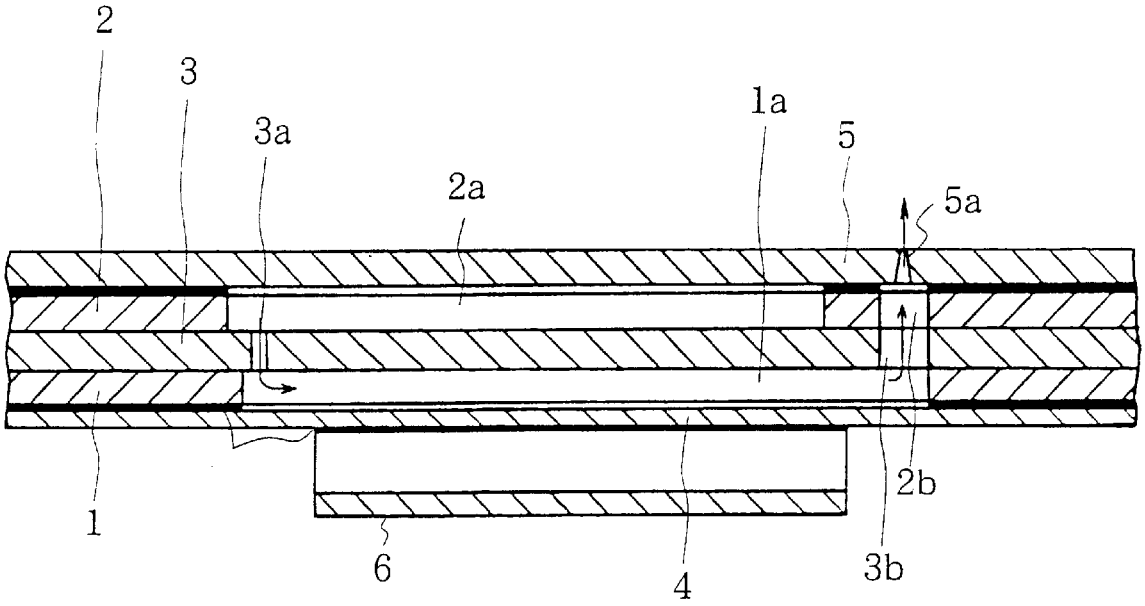
FIG. 3*a* is an enlarged cross section taken along a line A—A in FIG. 2.
Figure 3B:
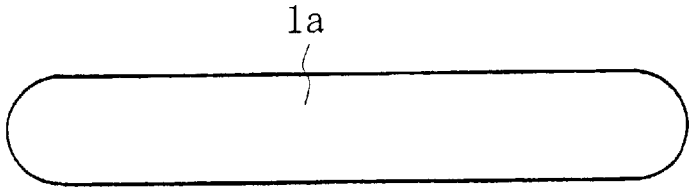
FIG. 3*b* is an enlarged plan view of the ink jet recording head shown in FIG. 2, showing a configuration of a discrete pressure chamber thereof.

1 to 3*b*, in which FIG. 1 is a perspective view of an ink jet recording head in disassembled state, which is manufactured according to a first embodiment of the manufacturing method of the present invention in disassembled state, FIG. 2 is a perspective view of the ink jet recording head shown in FIG. 1, in assembled state, FIG. 3*a* is an enlarged cross section taken along a line A—A in FIG. 2 and FIG. 3*b* is an enlarged plan view of the ink jet recording head shown in FIG. 2, showing a configuration of a discrete pressure chamber thereof.

The ink jet recording head manufactured according to the present method comprises ink supply metal plate 3 formed with a plurality of discrete ink supply ports 3*a* and a plurality of discrete nozzle holes 3*b*, pressure chamber plate 1 formed with a plurality of discrete pressure chambers la in the form of slots and having one surface in an intimate contact with one surface of ink supply metal plate 3, ink pool plate 2 formed with ink pool 2*a* and a plurality of discrete nozzle holes 2*b* and having one surface adhered to the other surface of ink supply metal plate 3 by an adhesive, vibration plate 4 adhered to the other surface of pressure chamber plate 1 by an adhesive, actuator 6 fixed to vibration plate 4 to pressurize ink within discrete pressure chambers 1*a* and nozzle plate 5 formed with a plurality of nozzles 5*a* and adhered to the other surface of pool plate 2 by an adhesive.

Ink supply plate 3, pressure chamber plate 1 and vibration plate 4 are formed with ink supply port 3*c*, ink supply port 1*c* and ink supply port 4*c*, respectively, and ink supply ports 3*c*, 1*c* and 4*c* are communicated with each other when assembled. Ink supply port 4*c* of vibration plate 4 is connected to ink supply pipe 7.

Discrete ink supply ports 3*a* of ink supply plate 3 are communicated on one side with ink pool 2*a* and on the other side with respective discrete pressure chambers 1*a* of pressure chamber plate 1. Discrete nozzle ports 3*b* of ink supply plate 3 are communicated on one side with nozzles 5*a* of nozzle plate 5 through discrete nozzle ports 2*b* of pool plate 2, respectively, and on the other side with discrete pressure chambers 1*a* of pressure chamber plate 1, respectively.

According to an example of sizes of the respective constructive components of the ink jet recording head according to the present invention, an area of the head in plan view being 5 mm wide and 5 mm long. Ink supply plate 3 is 0.075 mm thick. Diameters of discrete ink supply port 3*a* and discrete nozzle port are 0.03 mm and 0.19 mm, respectively. Pressure chamber plate 1 is 0.12 mm thick. Discrete pressure chamber 1*a* is 0.3 mm wide and 2.1 mm long. Seven discrete pressure chambers 1*a* are arranged with pitch of 0.508 mm. Pool plate 2 is 0.1 mm thick and 1.9 mm long in the longitudinal direction of discrete pressure chamber 1*a*.

Ink supply plate 3 is made of metal such as stainless steal. Pressure chamber plate 1 and pool plate 2 are formed from thin green sheets each of a paste containing ceramics powder, such as glass powder, and organic binder. The paste may contain metal powder of such as silver, titanium, etc., as an additive.

Ink supply plate 3 may be formed of glass-contained ceramics or of metal such as stainless steal.

In the ink jet recording head constructed as mentioned above, ink is supplied to ink pool 2*a* of pool plate 2 from an ink cartridge (not shown) through ink supply pipe 7 and respective ink supply ports 4*c*, 1*c* and 3*c* of vibration plate 4, pressure chamber plate 1 and ink supply plate 3.

Ink supplied to ink pool 2*a* is introduced from discrete ink supply ports 3*a* of ink supply plate 3 into discrete pressure chambers 1*a* of pressure chamber plate 1. When actuator 6 is driven in this state and vibration plate 4 is pressurized thereby, ink within discrete pressure chambers 1*a* is moved through discrete nozzle ports 3*b* of ink supply plate 3 and discrete nozzle ports 2*b* of pool plate 2 and is jetted from nozzles 5*a* of nozzle plate 5, as shown by an arrow in FIG. 3*a*.

Now, a manufacturing method of the ink jet recording head according to the present invention will be described.

First Embodiment

Figure 4:
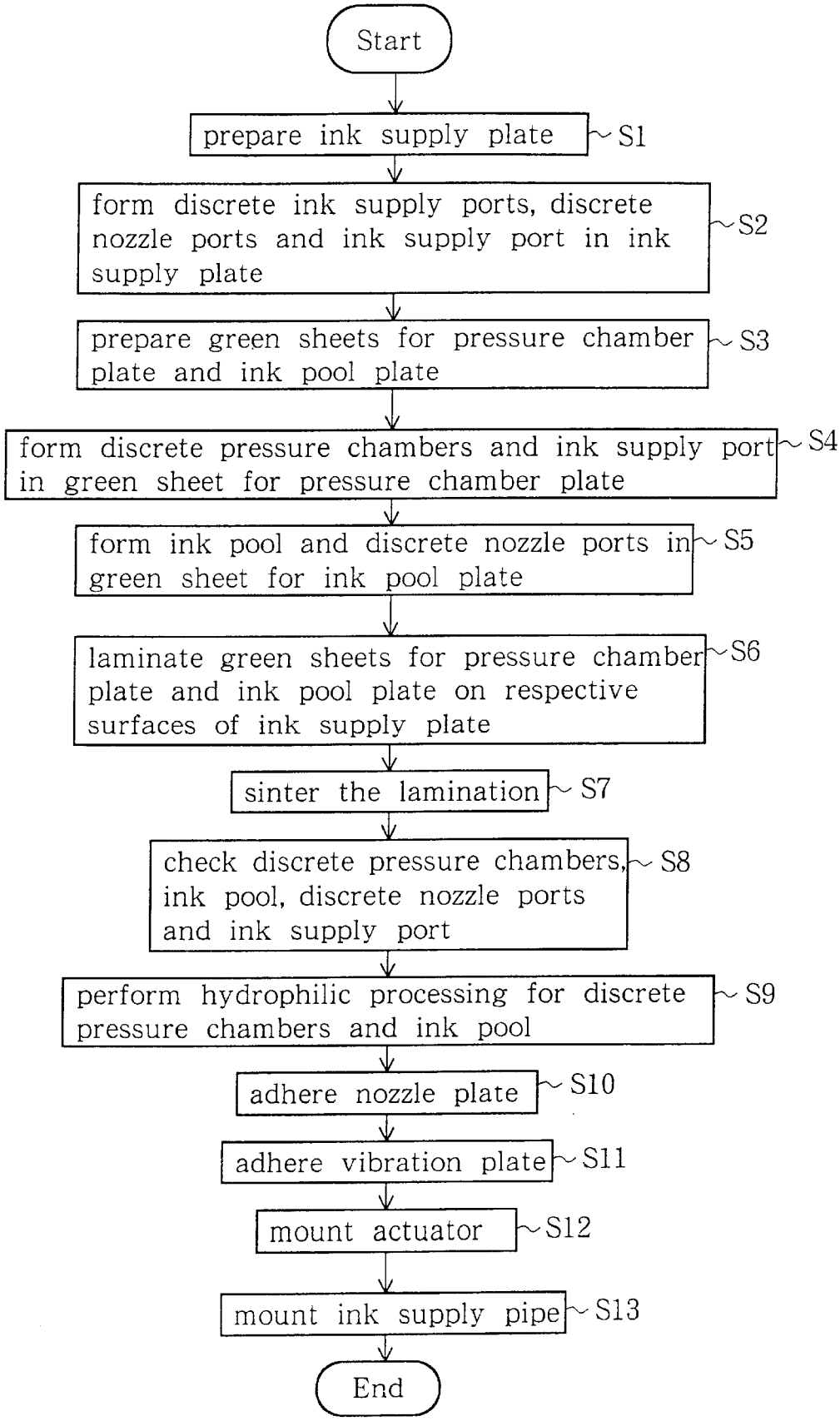
FIG. 4 is a flowchart showing the first embodiment of the manufacturing method of the present invention.
Figure 5:
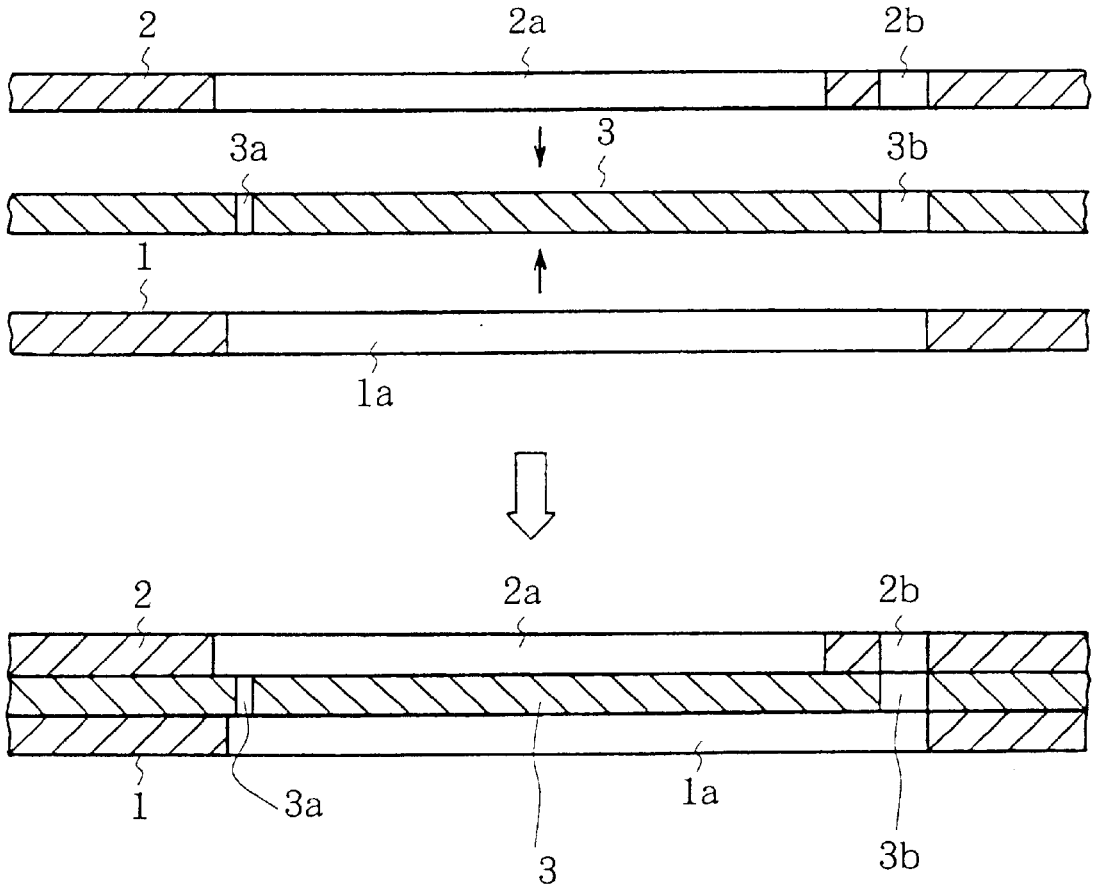
FIG. 5 is an enlarged partial cross section taken along the line A—A in FIG. 2, showing a portion of the manufacturing method of the first embodiment.

FIG. 4 is a flowchart showing the first embodiment of the manufacturing method of the present invention and FIG. 5 is an enlarged partial cross section taken along the line A—A in FIG. 2, showing a portion of the manufacturing method of the first embodiment.

First, for ink supply plate 3, a green sheet in the form of a thin film is prepared from a paste containing glass alumina powder and organic binder with silver as an additive (step S1). Then, a plurality (seven in this embodiment) of discrete ink supply ports 3*a*, the same number of nozzle ports 3*b* and ink supply port 3*c*, shown in FIG. 1, are formed in the green sheet as ink supply plate 3 by pressing with using a pinned tool (step S2). Then, a green sheet for pressure chamber plate 1 and a green sheet for pool plate 2 are prepared by using ceramic containing glass (step S3). Then, discrete pressure chambers 1*a* and ink supply port 1*c* shown in FIG. 1 are formed in the green sheet for pressure chamber plate 1 similarly (step S4) and ink pool 2*a* and discrete nozzle ports 2*b* are formed in the green sheet for pool plate 2. (step S5).

The green sheets for pressure chamber plate 1 and pool plate 2 are attached to respective surfaces of the green sheet for ink supply plate 3 with precision positioning to form a lamination (step S6). After pressing these green sheets together, the lamination is sintered at about 900° C. (step S7). After the sintering, discrete pressure chambers 1*a*, ink pool 2*a* and discrete nozzle ports 2*b* are checked from both sides of the lamination (step S8) and then the hydrophilic processing is performed for discrete pressure chambers 1*a* and ink pool 2*a* (step S9).

Thereafter, nozzle plate 5 formed with seven nozzles 5*a* as shown in FIG. 1 is adhered to pool plate 2 (step S10) and then vibration plate 4 formed with ink supply port 4*c* is adhered to pressure chamber plate 1 (step S11). Then, actuator 6 and ink supply pipe 7 are attached to vibration plate 4 (steps S12 and S13).

As a comparative example, ink supply plate 3 was formed from a stainless steal plate. It has been found that, with the use of ink supply plate 3 of stainless steal, it is possible to improve the preciseness of size of respective discrete ink supply ports 3*a* though there is slight warp and undulation in the lamination after sintering.

Second Embodiment

Figure 6:
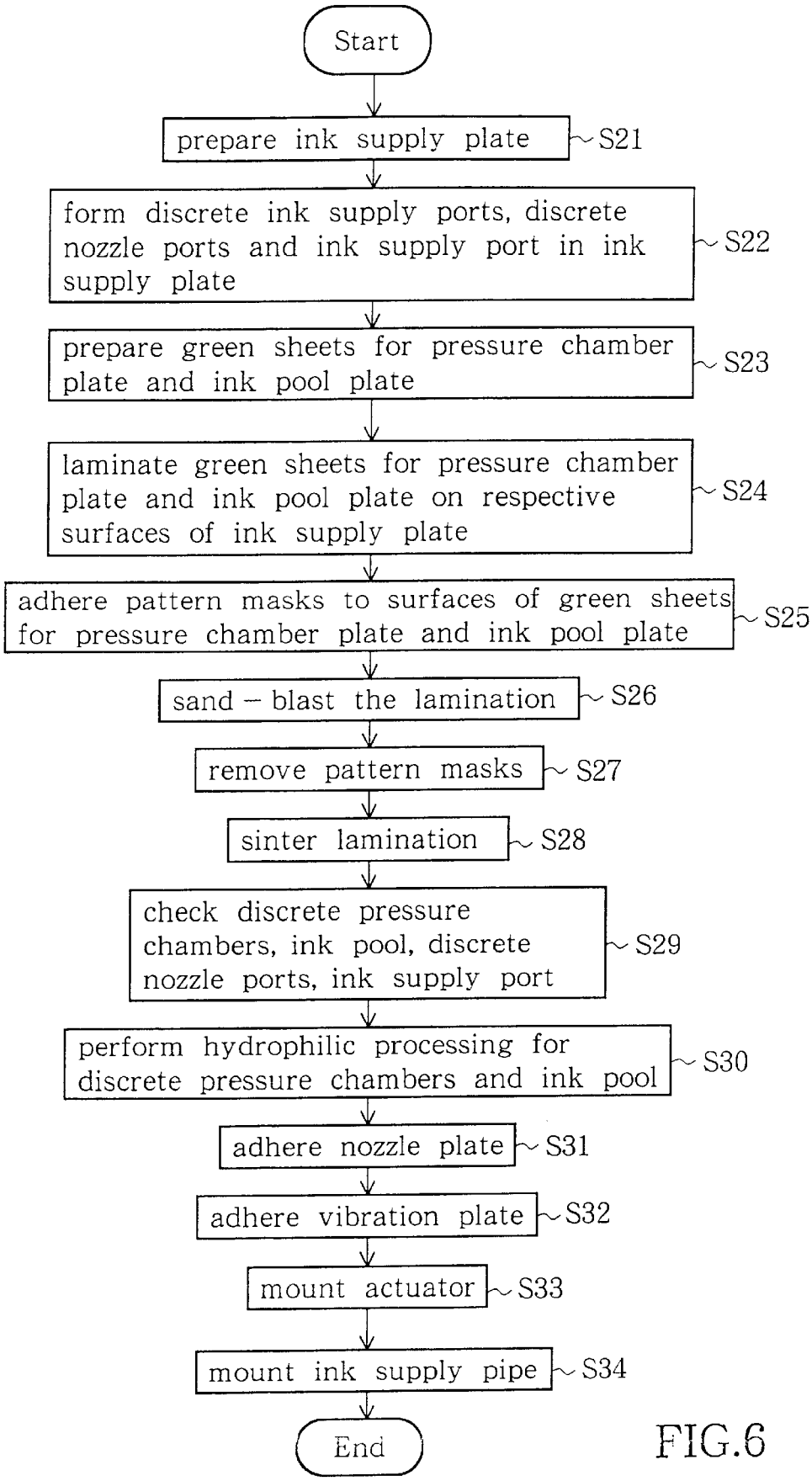
FIG. 6 is a flowchart showing a second embodiment of the manufacturing method of the present invention.
Figure 7:
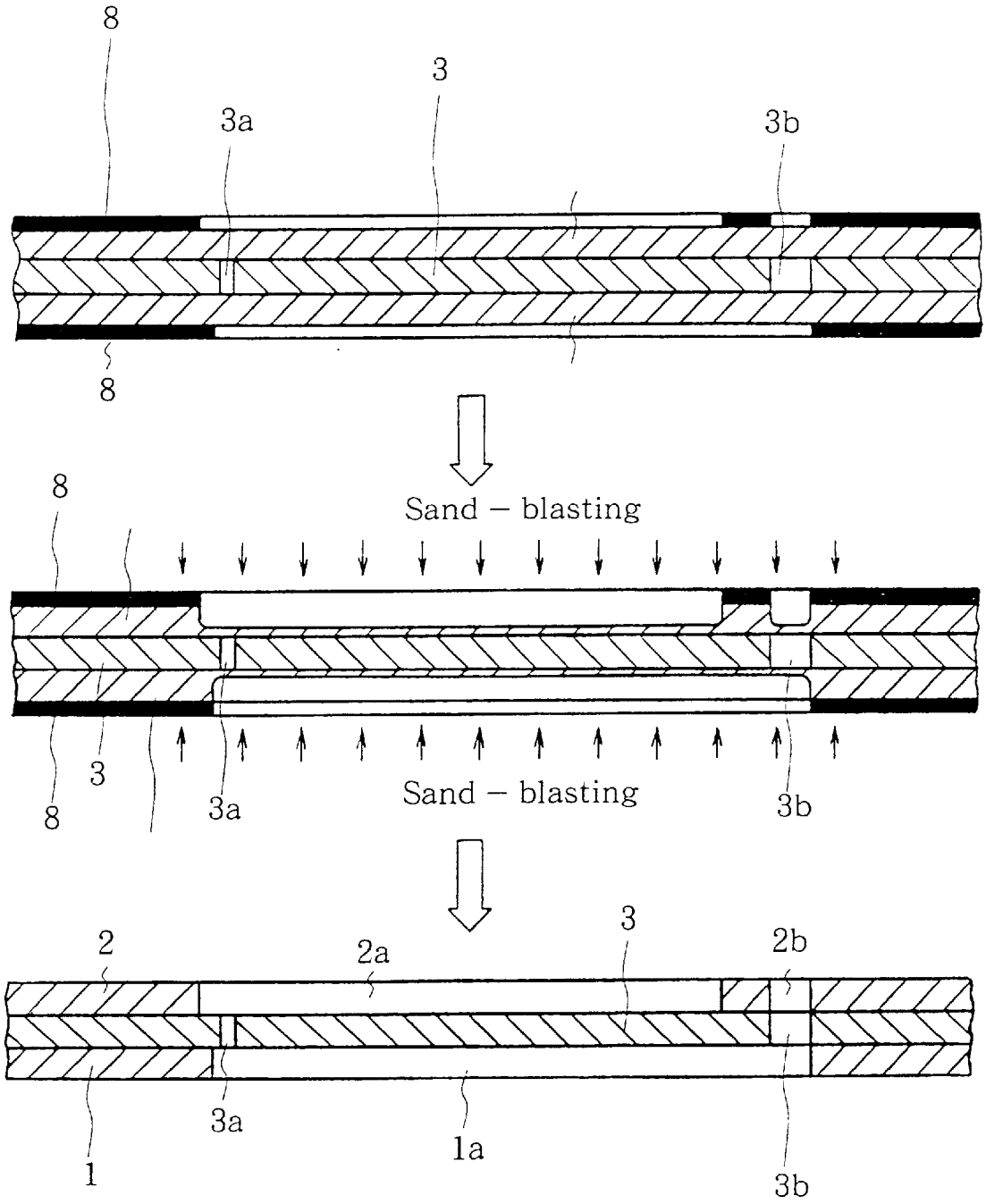
FIG. 7 is an enlarged partial cross section taken along the line A—A in FIG. 2, showing a portion of the manufacturing method of the second embodiment.

FIG. 6 is a flowchart showing a second embodiment of the manufacturing method of the present invention and FIG. 7 is an enlarged partial cross section taken along the line A—A in FIG. 2, showing a portion of the manufacturing method of the second embodiment.

In the second embodiment, metal ink supply plate 3 is prepared first (step S21). Then, seven discrete ink supply ports 3*a*, the same number of discrete nozzle ports 3*b* and ink supply port 3*c*, shown in FIG. 1, are formed in ink supply plate 3 (step S22). Then, in order to prepare a green sheet of glass-contained ceramics for pressure chamber plate 1 and a green sheet of glass-contained ceramics for pool plate 2, thin paste films containing glass powder and organic binder are formed on respective surfaces of ink supply plate 3 to form an upper green sheet and a lower green sheet (step S23) and a resultant lamination is prebaked to dehydrate it (step S24). Then, pattern mask 8 having holes corresponding to discrete pressure chambers 1*a* and ink supply port 1*c* is adhered to a surface of the lower green sheet of the lamination and pattern mask 8 having holes corresponding to ink pool 2*a* and discrete nozzle ports 2*b* is adhered to the other surface of the lamination (step S25). Then, the lamination is sand-blasted through pattern masks 8 to form discrete pressure chambers 1*a* and ink supply port 1*c* in the lower green sheet and ink pool 2*a* and discrete nozzle ports 2*b* in the upper green sheet (step S26).

Then, pattern masks 8 are removed (step S27) and the lamination is sintered at about 600° C. (step S28). Although a small amount of green sheets is left in bottom portions of discrete pressure chambers 1*a* and ink pool 2*a* after the sintering, the residual green sheets are removed in a check step after the sintering step, similarly to those in the first embodiment.

That is, discrete pressure chambers 1*a*, ink pool 2*a* and discrete nozzle ports 2*b* are checked from both sides of the lamination (step S29) and then the hydrophilic processing is performed for discrete pressure chambers 1*a* and ink pool 2*a* (step S30). Then, nozzle plate 5 having nozzles 5*a* is adhered to pool plate 2 (step S31) and vibration plate 4 having ink supply port 4*c* is adhered to pressure chamber plate 1 (step S32). Then, actuator 6 and ink supply pipe 7 are attached to vibration plate 4 (steps S33 and S34).

As an example of the method of the second embodiment, pattern masks 8 were formed by adhering urethane film resists each 50 μm thick to the respective surfaces of the lamination by using a lamination device. Then, photo masks were adhered to the respective pattern masks 8 and exposed with ultra violet ray. Thereafter, the photo masks were developed with weak alkaline liquid of 1% aqueous solution of sodium carbonate to remove unnecessary portion of the resist. Then, after the pattern masks 8 were baked at about 100° C., the lamination was set in a sand-blasting device and the lamination was bombarded by glass beads of #1000 mesh size. In this bombardment with glass beads, a distance between a nozzle from which beads are supplied and the surface of the lamination was set to 100 mm and, in order to uniformly sand-blast the lamination, the nozzle and the lamination was relatively reciprocated.

The lamination including metal ink supply plate 3 was compared with a lamination having an ink supply plate made of green sheet. It has been found that, with the use of metal ink supply plate 3, the flatness and parallelism of the surfaces of the lamination including metal ink supply plate 3 after the sintering was improved though the preciseness of supply ports 3*a* was slightly degraded.

Third Embodiment

Figure 8:
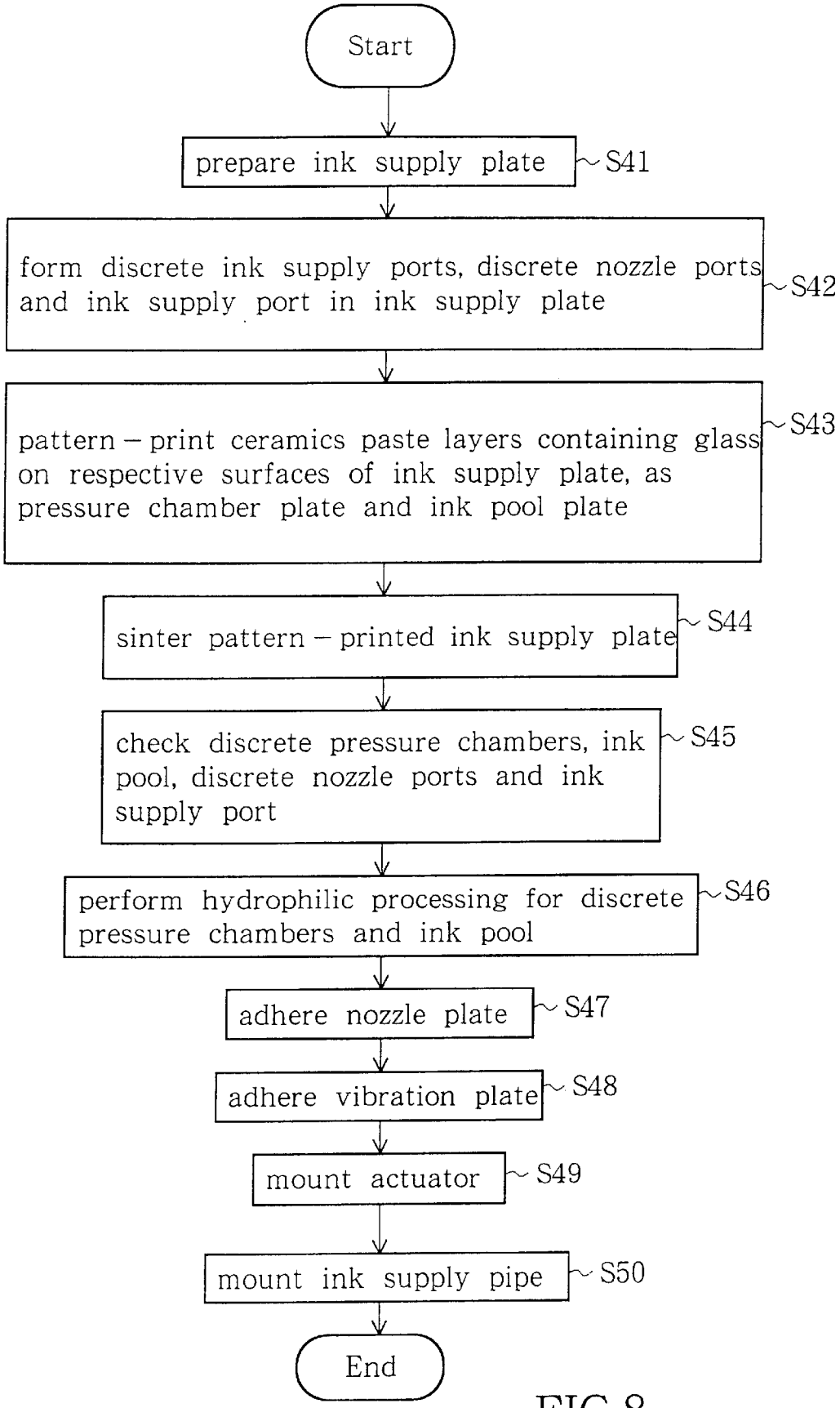
FIG. 8 is a flowchart showing a third embodiment of the manufacturing method of the present invention.
Figure 9:
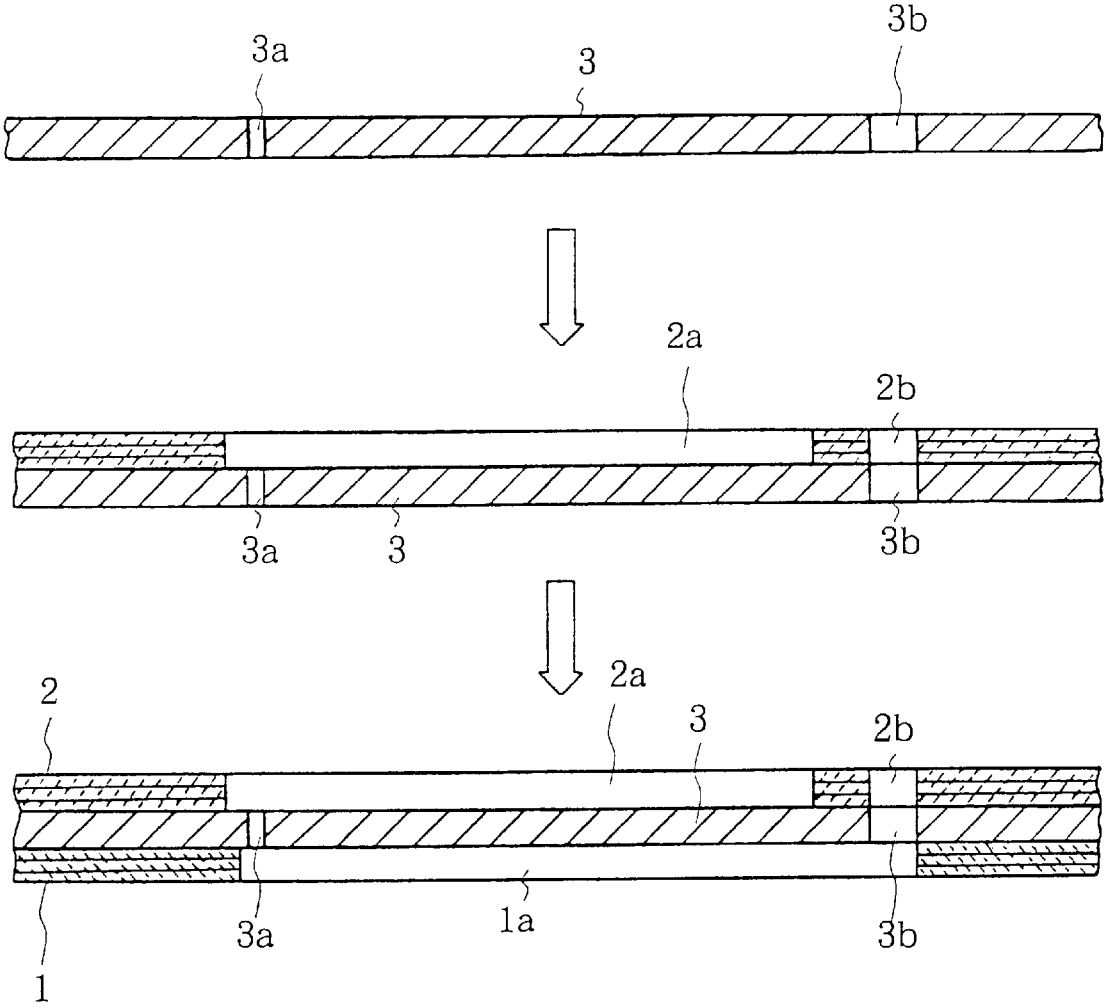
FIG. 9 is an enlarged partial cross section taken along the line A—A in FIG. 2, showing a portion of the manufacturing method of the third embodiment.

FIG. 8 is a flowchart showing a third embodiment of the manufacturing method of the present invention and FIG. 9 is an enlarged partial cross section taken along the line A—A in FIG. 2, showing a portion of the manufacturing method of the third embodiment;

In the third embodiment, metal ink supply plate 3 is prepared first (step S41). Then, 7 discrete ink supply ports 3*a*, the corresponding number of discrete nozzle ports 3*b* and ink supply port 3*c*, shown in FIG. 1, are formed in ink supply plate 3 (step S42). Then, respective surfaces of ink supply plate 3 are pattern-printed with paste containing glass powder and organic binder to prepare a green sheet of glass-contained ceramics for pressure chamber plate 1 and a green sheet of glass-contained ceramics for pool plate 2 (step S43). Ink supply plate 3 with the green sheets is sintered at about 600° C. (step S44). With this sintering, pressure chamber plate 1 formed with ink supply port 1*c* and pool plate 2 formed with ink pool 2*a* and discrete nozzle ports 2*b* are laminated on the respective surfaces of ink supply plate 3.

In this state, discrete pressure chambers 1*a*, ink pool 2*a* and discrete nozzle ports 2*b* are checked from both sides of the lamination (step S45) and then the hydrophilic processing is performed for discrete pressure chambers 1*a* and ink pool 2*a* (step S46). Then, nozzle plate 5 having seven nozzles 5*a* is adhered to pool plate 2 (step S47) and vibration plate 4 having ink supply port 4*c* is adhered to pressure chamber plate 1 (step S48). Then, actuator 6 and ink supply pipe 7 are attached to vibration plate 4 (steps S49 and S50).

As an example of the method of the third embodiment, the pattern printing on the side of pool plate 2 was performed three times to laminate three paste layers each about 40 μm thick. The pattern printing on the side of discrete pressure chambers 1*a* was performed four times to laminate four paste layers each about 36 μm thick. By sintering the ink supply plate having the patterned paste layers at about 600° C., the paste layers were shrunken to provide pool plate 2 having thickness of 0.1 mm and pressure chamber plate 1 having thickness of 0.12 mm.

The lamination including metal ink supply plate 3 was compared with a lamination having an ink supply plate made of green sheet. It has been found that, with the use of metal ink supply plate 3, the flatness and parallelism of the surfaces of the lamination including metal ink supply plate 3 after the sintering was improved though the preciseness of supply ports 3*a* was slightly degraded.

Fourth Embodiment

Figure 10:
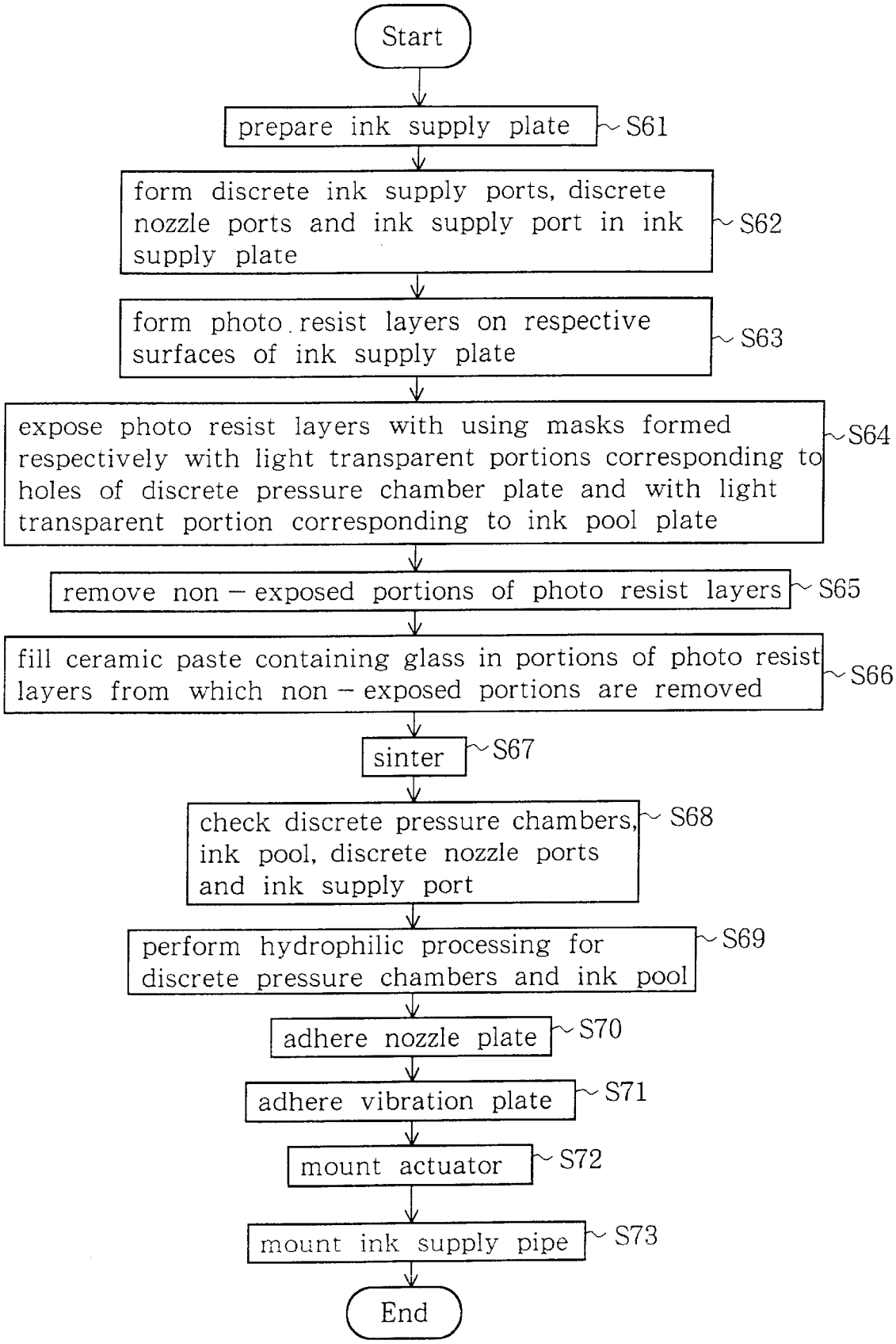
FIG. 10 is a flowchart showing a fourth embodiment of the manufacturing method of the present invention.
Figure 11:
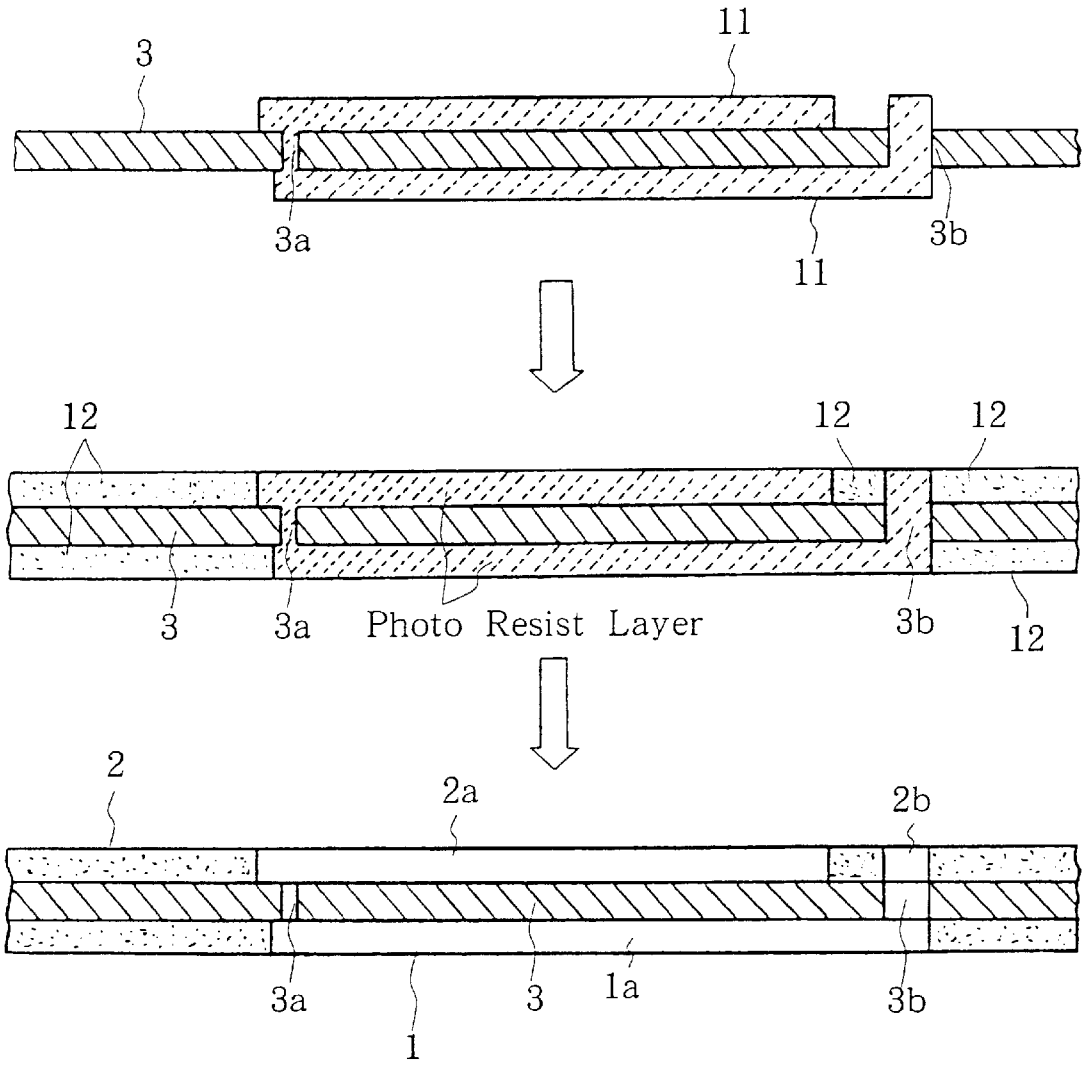
FIG. 11 is an enlarged partial cross section taken along the line A—A in FIG. 2, showing a portion the manufacturing method of the fourth embodiment.

FIG. 10 is a flowchart showing a fourth embodiment of the manufacturing method of the present invention and FIG. 11 is an enlarged partial cross section taken along the line A—A in FIG. 2, showing a portion of the manufacturing method of the fourth embodiment.

In the fourth embodiment, metal ink supply plate 3 is prepared first (step S61). Then, seven discrete ink supply ports 3*a*, the corresponding number of discrete nozzle ports 3*b* and ink supply port 3*c*, shown in FIG. 1, are formed in ink supply plate 3 (step S62). Then, photo resist layers are formed on respective surfaces of ink supply plate 3 (step S63). Then, the photo resist layers are exposed with using a mask having a light transparent portion corresponding to holes of discrete pressure chambers 1*a* and ink supply port 1*c* of pressure chamber plate 1 and a mask having a light transparent portion corresponding to holes of ink pool 2*a* and discrete nozzle ports 2*b*, respectively (step S64). Then, unexposed portions of the photo resist layers are removed (step S65). Residual portions, that is, the exposed portions, of the photo resist layers are shown by reference numeral 11.

Thereafter, the portions from which the unexposed portions of the photo resist layers are removed are filled with ceramics paste 12 containing glass (step S66) and ceramic paste 12 is sintered (step S67). With this sintering, the photo resist layers are removed, resulting in a lamination of pressure chamber plate 1 formed with ink supply port 1*c*, ink supply plate 3 formed with discrete ink supply ports 3*a* and discrete nozzle ports 3*b* and pool plate 2 formed with ink pool 2*a* and discrete nozzle ports 2*b*.

In this state, discrete pressure chambers 1*a*, ink pool 2*a* and discrete nozzle ports 2*b* are checked from both sides of the lamination (step S68) and then the hydrophilic processing is performed for discrete pressure chambers 1*a* and ink pool 2*a* (step S69). Then, nozzle plate 5 having seven nozzles 5*a* is adhered to pool plate 2 (step S70) and vibration plate 4 having ink supply port 4*c* is adhered to pressure chamber plate 1 (step S71). Then, actuator 6 and ink supply pipe 7 are attached to vibration plate 4 (steps S72 and S73).

Although, in the fourth embodiment, the exposition of the photo resist layers is performed by using the masks each having the pattern of the light transparent portion corresponding to the ink pool or the discrete pressure chambers and the translucent portion corresponding to the discrete pressure chambers and the non-exposed portion thereof is removed, it may be possible to expose a photosensitive resin instead of the photo resist by using masks each having an reversed pattern of the light transparent portion and the translucent portion and to remove exposed portions thereof.

The lamination including metal ink supply plate 3 was compared with a lamination having an ink supply plate made from a green sheet. It has been found that, with the use of metal ink supply plate 3, the flatness and parallelism of the surfaces of the lamination including metal ink supply plate 3 after the sintering was improved though the preciseness of discrete supply ports 3*a* was slightly degraded.

Fifth Embodiment

Figure 12:
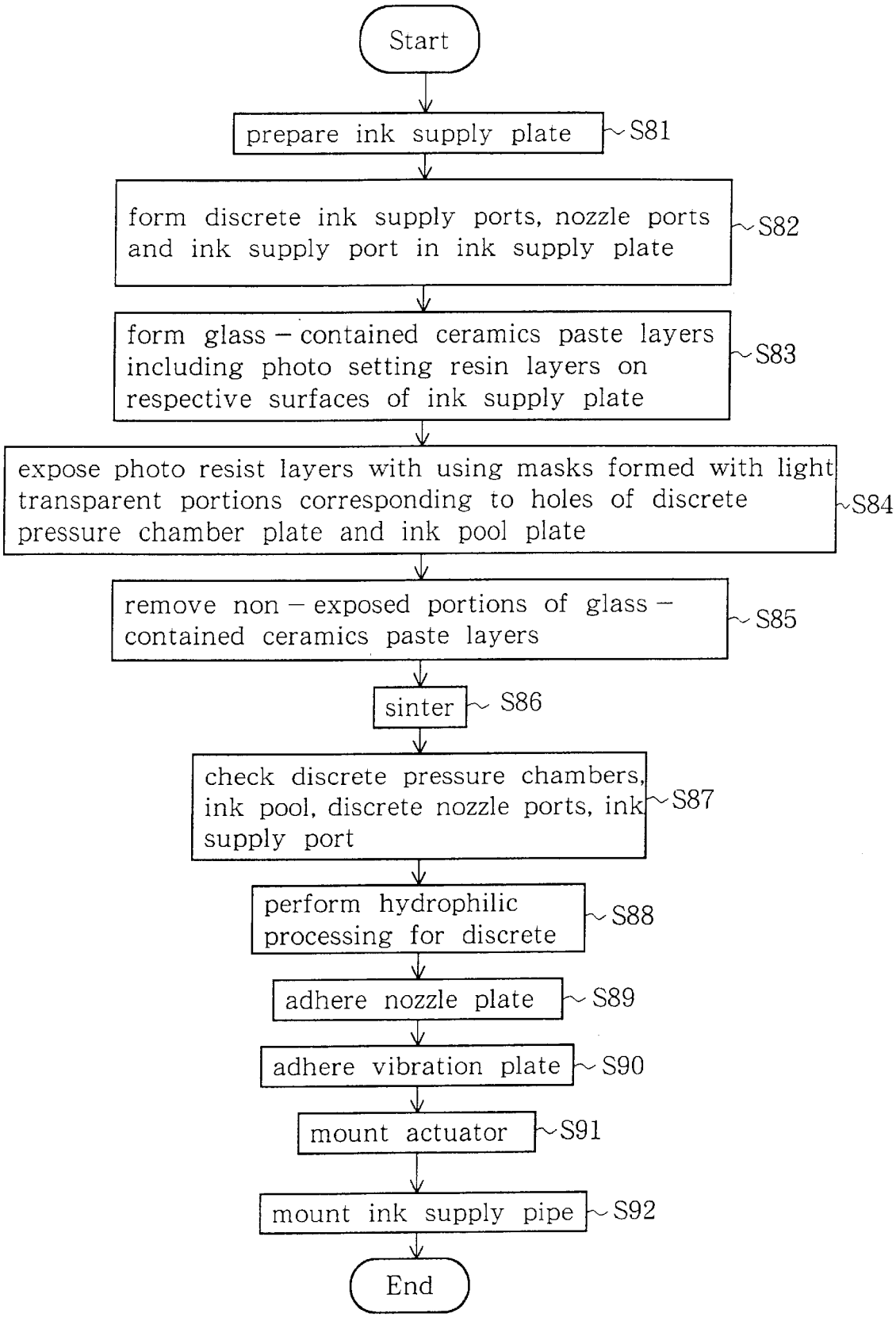
FIG. 12 is a flowchart showing a fifth embodiment of the manufacturing method of the present invention.
Figure 13:
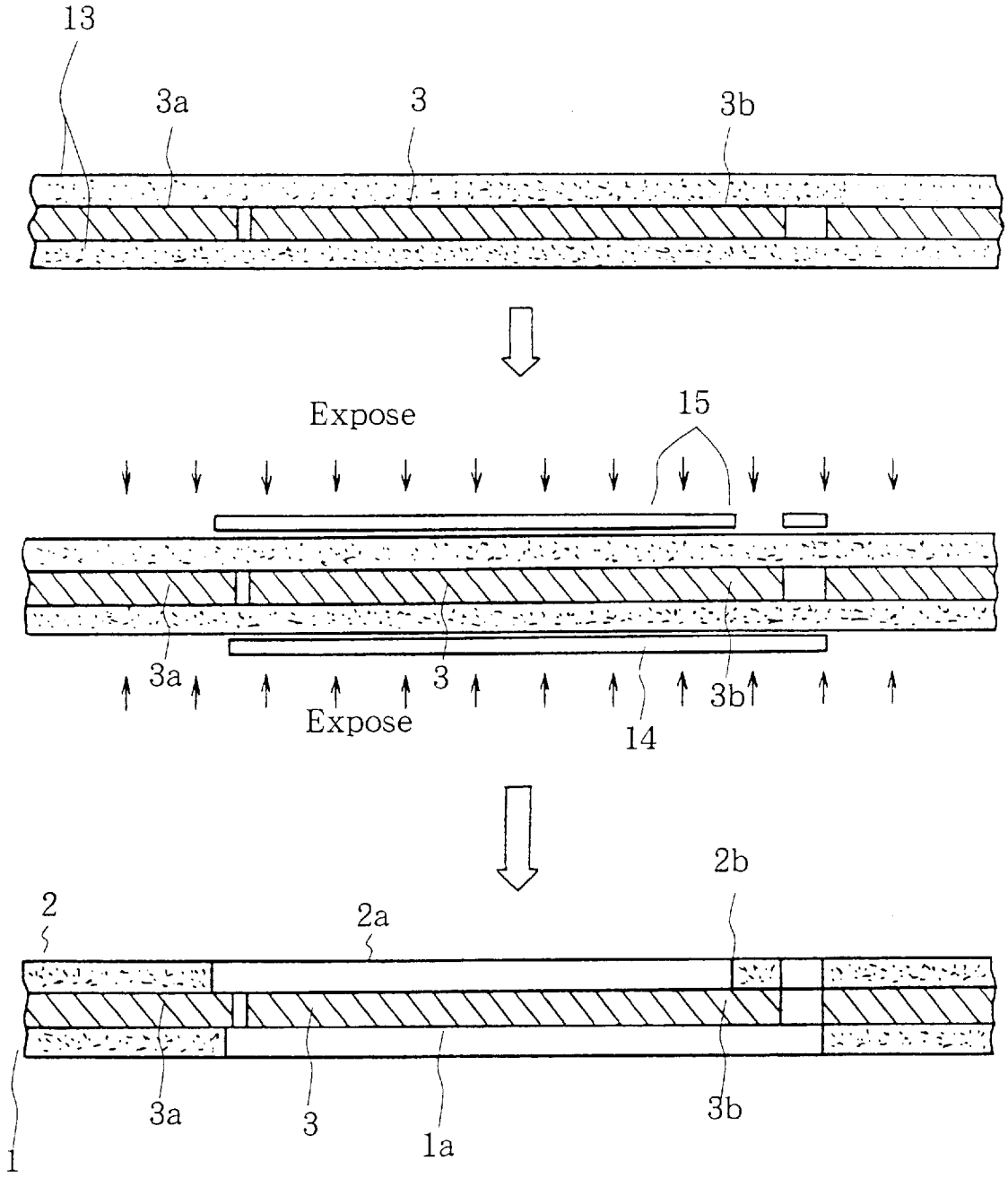
FIG. 13 is an enlarged partial cross section taken along the line A—A in FIG. 2, showing a portion of the manufacturing method of the fifth embodiment.

FIG. 12 is a flowchart showing a fifth embodiment of the manufacturing method of the present invention and FIG. 13 is an enlarged partial cross section taken along the line A—A in FIG. 2, showing a portion of the manufacturing method of the fifth embodiment.

In the fifth embodiment, metal ink supply plate 3 is prepared first (step S81). Then, seven discrete ink supply ports 3*a*, the corresponding number of discrete nozzle ports 3*b* and ink supply port 3*c*, shown in FIG. 1, are formed in ink supply plate 3 (step S82). Then, ceramics paste layers 13 containing glass and photo-setting resin are formed on respective surfaces of ink supply plate 3 (step S83). Then, ceramics paste layers 13 are exposed with using a mask having a light translucent portion corresponding to discrete pressure chambers 1*a* and ink supply port 1*c* of pressure chamber plate 1 and a mask having a light translucent portion corresponding to ink pool 2*a* and discrete nozzle ports 2*b*, respectively (step S84). Then, after unexposed portions of the ceramics paste layers are removed (step S85), the ceramics paste layers are sintered (step S86).

With this sintering, pressure chamber plate 1 formed with ink supply port 1*c*, ink supply plate 3 formed with discrete ink supply ports 3*a* and discrete nozzle ports 3*b* and pool plate 2 formed with ink pool 2*a* and discrete nozzle ports 2*b* are laminated.

In this state, discrete pressure chambers 1*a*, ink pool 2*a* and discrete nozzle ports 2*b* are checked from both sides of the lamination (step S87) and then the hydrophilic processing is performed for discrete pressure chambers 1*a* and ink pool 2*a* (step S88). Then, nozzle plate 5 having nozzles 5*a* is adhered to pool plate 2 (step S89) and vibration plate 4 having ink supply port 4*c* is adhered to pressure chamber plate 1 (step S90). Then, actuator 6 and ink supply pipe 7 are attached to vibration plate 4 (steps S91 and S92).

Although, in the fifth embodiment, the exposition is performed by using the masks each having the pattern of the light transparent portion and the light translucent portion corresponding to the ink pool or the pressure chambers and the non-exposed portion is removed, it may be possible to expose a photosensitive resin instead of the photo resist by using masks each having an reversed pattern of the light transparent portion and the translucent portion and to remove exposed portions thereof.

The lamination including metal ink supply plate 3 was compared with a lamination having an ink supply plate made from a green sheet. It has been found that, with the use of metal ink supply plate 3, the flatness and parallelism of the surfaces of the lamination including metal ink supply plate 3 after the sintering was improved though the preciseness of discrete supply ports 3*a* was slightly degraded.

As described hereinbefore, according to the present invention, it is possible to form the wall surfaces, which define the pressure chambers and the ink pool of the ink jet recording head, of ceramics superior in durability against ink, to thereby make the mechanical displacement of the discrete pressure chambers of the ink jet recording head small and make the check of the interiors of the discrete pressure chambers and the ink pool possible. Since, therefore, it is possible to exclude ink jet recording heads having defects such as falling-off of the ceramics parts and deformation thereof during sintering before the ink jet recording heads are finished, it is possible to improve the reliability of products and the yield thereof.

Further, since the sintering is performed with the discrete pressure chambers being in open state, it becomes possible to perform the hydrophilic processing and other processing for the interior of the discrete pressure chambers. Therefore, it is possible to improve the durability against ink to thereby improve the recording performance of the ink jet recording head. In addition, since a fine machining becomes possible by the present method and to reduce the cross-talk between adjacent discrete pressure chambers, the density of the discrete pressure chambers can be increased, the compactness of the head can be realized and the number of nozzles can be increased.

What is claimed is:

1. A method for manufacturing an ink jet recording head having discrete pressure chambers each having ceramic wall surfaces, comprising the steps of:

laminating, on opposite surfaces of an ink supply plate formed with a plurality of discrete ink supply ports and corresponding discrete nozzle ports, a green sheet for a pressure chamber plate and a green sheet for an ink pool plate respectively, to create a lamination, the lamination being such that the green sheet for the pressure chamber plate and the green sheet for the ink pool plate are directly laminated to the ink supply plate without providing any intermediate layers;

sintering the lamination; and adhering a vibration plate to said pressure chamber plate sintered in the sintering step and a nozzle plate to said sintered pool plate.

2. A method for manufacturing an ink jet recording head having discrete pressure chambers each having ceramic wall surfaces, comprising the steps of:

laminating, on opposite surfaces of an ink supply plate formed with a plurality of discrete ink supply ports and corresponding discrete nozzle ports, a green sheet for a pressure chamber plate and a green sheet for an ink pool plate, respectively, to create a lamination;

sintering the lamination; and adhering a vibration plate to said pressure chamber plate sintered in the sintering step and a nozzle plate to said sintered pool plate;

further comprising, between the sintering step and the adhering step, a step of checking wall surfaces of said discrete pressure chambers.

3. A method for manufacturing an ink jet recording head having discrete pressure chambers each having ceramic wall surfaces, comprising the steps of:

laminating, on opposite surfaces of an ink supply plate formed with a plurality of discrete ink supply ports and corresponding discrete nozzle ports, a green sheet for a pressure chamber plate and a green sheet for an ink pool plate, respectively, to create a lamination;

sintering said lamination; and adhering a vibration plate to said pressure chamber plate sintered in said sintering step and a nozzle plate to said sintered pool plate;

further comprising, between said sintering step and said adhering step, a step of performing a hydrophilic processing with respect to said ceramic wall surfaces of said discrete pressure chambers.

4. The method as claimed in claim 1, wherein, prior to said laminating step, a plurality of holes corresponding to spaces of said discrete pressure chambers are formed in said green sheet for said pressure chamber plate.

5. The method as claimed in claim 1, wherein, prior to said laminating step, a hole corresponding to a space of an ink pool is formed in said green sheet for said ink pool plate.

6. The method as claimed in claim 1, further comprising, after the laminating step and before the sintering step, a step of forming a plurality of holes corresponding to spaces of the discrete pressure chambers in the green sheet for the pressure chamber plate.

7. The method as claimed in claim 1, further comprising, after the laminating step and before the sintering step, a step of forming a hole corresponding to a space of the ink pool in the green sheet for the ink pool plate.

* * * * *